United States Patent [19]

Ward

[11] Patent Number: 4,536,934

[45] Date of Patent: Aug. 27, 1985

[54] SHADE CLOTH PIN INSERTER

[76] Inventor: Francis P. Ward, P.O. Box 38632, Winnellie, Darwin, N.T., Australia, 5789

[21] Appl. No.: 528,734

[22] Filed: Sep. 1, 1983

[30] Foreign Application Priority Data

Apr. 22, 1983 [AU] Australia ..... 1390783

[51] Int. Cl.[3] ..... B25B 27/14

[52] U.S. Cl. ..... 29/278

[58] Field of Search ..... 223/102, 103, 104; 139/380, 1.5; 29/278, 291

[56] References Cited

U.S. PATENT DOCUMENTS

| | | | |
|---|---|---|---|
| 362,700 | 5/1887 | Ball | 139/380 |
| 382,750 | 5/1888 | Bradford | 223/104 |
| 389,235 | 9/1888 | McBrayer | 223/102 |
| 3,442,235 | 5/1969 | Gibson | 223/104 |

*Primary Examiner*—Robert C. Watson

*Attorney, Agent, or Firm*—Pearne, Gordon, Sessions, McCoy, Granger & Tilberry

[57] ABSTRACT

A pin inserter for inserting a plastic pin (7) through overlapped areas of shade cloth. The pin inserter has a handle (2) and a curved needle (3), with the pin having one end received in a recess (8) in the handle and its other end resting on the needle so it is slightly stressed to form a chord across the curvature of the needle.

1 Claim, 4 Drawing Figures

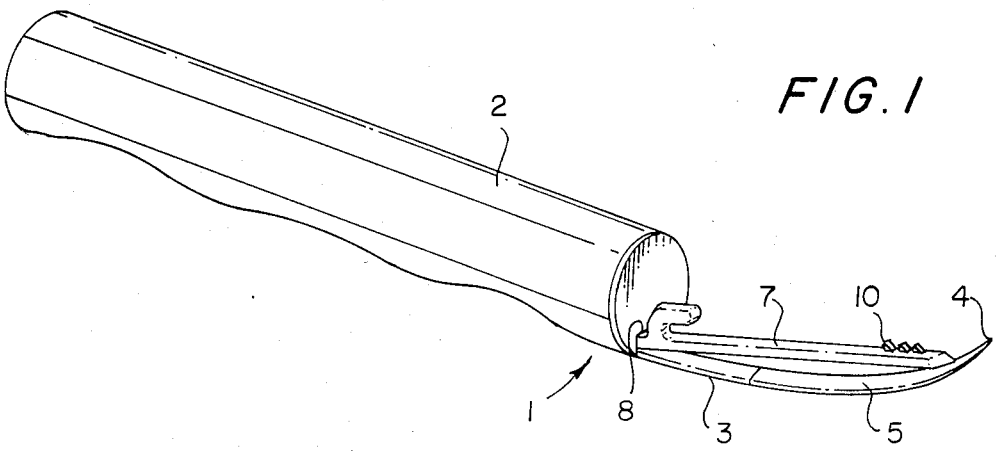
FIG. 1
FIG. 2
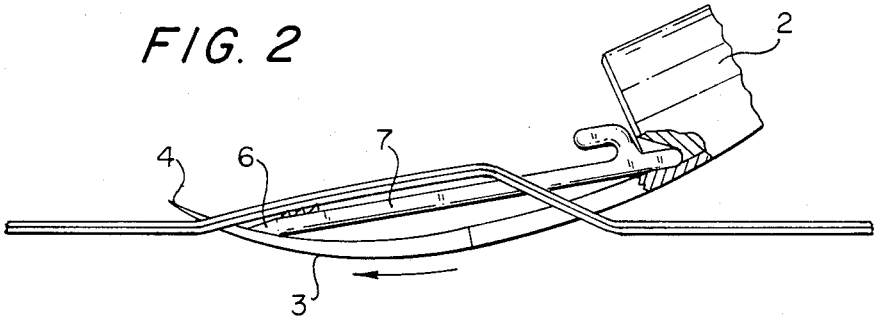
FIG. 3
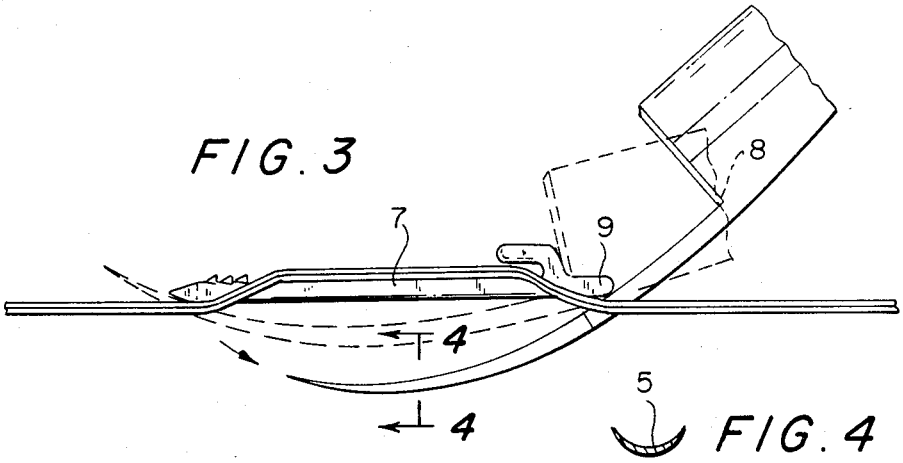
FIG. 4

SHADE CLOTH PIN INSERTER

This invention relates to a device for inserting a shade cloth pin through overlapping layers of shade cloth.

In Australian Petty Pat. No. 525606 there is described a shade cloth pin for joining overlapping portions of shade cloth, the pin having at one end a point, barbs being provided adjacent the point for engaging the shade cloth when the pin is inserted.

At its opposite end the pin is provided with a hook-shaped member to also engage the shade cloth, the hook-shaped member and the barbs thus locating the pin in the shade cloth, and prevents the inadvertent removal of the pin during movement and flapping of the shade cloth due to wind action and the like.

The pins have been found to be very satisfactory but at times difficulty is encountered in inserting the pin, particularly where the overlapping portions are in large areas such as in shade houses or the like, and which when the pin is used to replace existing fastening means, or is used in erection where the shade cloth has been pulled tight and stretched, that it is difficult to insert the pin from one side only and often a second person is required on the other side of the shade cloth to insert the pin through the cloth.

In order to overcome this problem a pin inserter has been provided so that a person operating from one side only of the shade cloth can quickly insert the pins.

Thus there is provided according to the invention a shade cloth pin inserter for passing the pin through the shade cloth to pin overlapping portions of the shade cloth together, said inserter comprising a curved needle extending from a handle, the needle being curved to receive the pin as a chord across the curvature of the needle, so that due to the curvature the pin can be inserted through the overlapping portions in a pinning action, the pin being retained when the needle is removed.

In order to more fully describe the invention reference will now be made to the accompanying drawings in which FIG. 1 is a perspective view of the shade cloth pin inserter showing the pin positioned on the needle, FIG. 2 shows the action of the inserter in inserting the pin, and FIG. 3 shows the pin inserted and the inserter being removed.

FIG. 4 is a cross-section of the pin inserter along the line 4—4 of FIG. 3.

The inserter 1 comprises a handle 2 to which is attached a curved needle 3. The needle 3 extends in the preferred form from one side of the handle generally in line with the handle and then is curved to extend at its pointed end 4 across the end of the handle.

The needle is formed of a suitable material such as stainless steel, or spring steel or the like and is provided on its concave face 5 with a recess or the like so that the end 6 of the bin 7 is received in this shaped portion.

A recess 8 is provided adjacent to and opening onto the base of the needle 3, this recess receiving the end 9 of the pin 7. The recess 8 is such that when the pin 7 is positioned the pin is slightly stressed so that it is retained in position as a chord across the curved pin.

It will be seen that it is merely necessary to insert the needle from one side of the shade cloth, the curvature allowing the needle and pin to then pass back through the shade cloth, and when the barbs 10 on the pin pass through the shade cloth, the needle can be removed, the barbs 10 engaging on the shade cloth to retain the pin so that it is removed from the needle.

In this way it will be seen that it is simple to insert the pins through the shade cloth in a simple action, experience soon indicating the desired amount that the needle has to be inserted through the shade cloth, that is the spacing along the shade cloth between the points where the needle is inserted and returns back through the shade cloth.

It will be realised that the needle can be attached in any suitable manner to the handle, and the handle itself can be formed of any suitable material, such as wood, plastics or even metal.

It will be realised that the handle and needle could take other forms falling within the spirit of the invention, the handle and needle being such that it will retain the pin in position during the insertion through the shade cloth, and will allow easy removal of the pin from the inserter during the withdrawal of the inserter.

Although one form of the invention has been described in some detail it is to be realised that the inserter can be varied while still falling within the scope of the appended claims.

The claims defining the invention are as follows:

1. A shade cloth pin inserter for passing a pin through the shade cloth to pin overlapping portions of shade cloth together, said inserter comprising a handle, a curved needle extending from the handle, a recess in the handle opening onto the needle where it extends from the handle, said needle being curved in side elevation so that a pin can be inserted into said recess adjacent said needle and extend as a chord across the curved needle to be slightly stressed and retained therein, said needle in cross-section being concave so that the end of the pin is located therein.

* * * * *